US008118029B2

(12) United States Patent
Gneiting et al.

(10) Patent No.: US 8,118,029 B2
(45) Date of Patent: Feb. 21, 2012

(54) PATIENT LATERAL POSITIONING DEVICE FOR PELVIC TREATMENTS COMPRISING A VACUUM MATTRESS

(75) Inventors: Sabine Gneiting, Taufkirchen (DE); Benjamin Wagner, Munich (DE); Florian Schindler, Affoltern am Albis (CH)

(73) Assignee: Brainlab AG, Feldkirchen (DE)

( * ) Notice: Subject to any disclaimer, the term of this patent is extended or adjusted under 35 U.S.C. 154(b) by 843 days.

(21) Appl. No.: 12/105,554

(22) Filed: Apr. 18, 2008

(65) Prior Publication Data

US 2009/0044813 A1 Feb. 19, 2009

Related U.S. Application Data

(60) Provisional application No. 60/917,097, filed on May 10, 2007.

(30) Foreign Application Priority Data

Apr. 18, 2007 (EP) ..... 07007844

(51) Int. Cl.
*A61G 15/00* (2006.01)
*A47C 17/86* (2006.01)

(52) U.S. Cl. ..... 128/845; 5/630; 5/648

(58) Field of Classification Search ..... 5/621, 624, 5/610, 623, 657, 630, 648; 128/845, 846, 128/869, 877, 882; 378/209, 208, 204
See application file for complete search history.

(56) References Cited

U.S. PATENT DOCUMENTS

| | | | | |
|---|---|---|---|---|
| 5,390,383 | A * | 2/1995 | Carn | 5/624 |
| 5,906,205 | A | 5/1999 | Hiebert | |
| 6,311,349 | B1 | 11/2001 | Kazakia et al. | |
| 6,934,987 | B2 * | 8/2005 | Newkirk et al. | 5/613 |
| 2004/0171974 | A1 * | 9/2004 | Emsky | 602/33 |

FOREIGN PATENT DOCUMENTS

WO 2004/089192 10/2004

* cited by examiner

*Primary Examiner* — Patricia Bianco
*Assistant Examiner* — Tarla Patel
(74) *Attorney, Agent, or Firm* — Renner, Otto, Boisselle & Sklar, LLP

(57) ABSTRACT

A patient lateral positioning device for pelvic treatments suitable to support a patient in a defined lateral position includes a vacuum mattress. The vacuum mattress includes an upper body support attachable to an upper body portion of the patient, and a lower body support attachable to a lower body portion of the patient. A region between said upper and lower body support is formed such that when the vacuum mattress is attached to the patient, both a front pelvic side and an upper pelvic side of the patient are exposed.

16 Claims, 3 Drawing Sheets

PATIENT LATERAL POSITIONING DEVICE FOR PELVIC TREATMENTS COMPRISING A VACUUM MATTRESS

RELATED APPLICATION DATA

This application claims priority of U.S. Provisional Application No. 60/917,097 filed on May 10, 2007, which is incorporated herein by reference in its entirety.

FIELD OF THE INVENTION

The invention relates to a patient lateral positioning device for pelvic treatments.

BACKGROUND OF THE INVENTION

In pelvic treatments, in particular hip replacement operations, patients typically are operated on while lying on their side, and this requires the patient to be fixed such that their pelvis is positioned at rest. This is conventionally achieved using patient positioners, which comprise supporting means for the lower region of the patient's body. In this position, however, it is often difficult to ascertain navigation information by tapping body landmarks (ASIS and pubic points) within the framework of medical navigation, because these characteristic pelvic landmarks are in most cases difficult to access, at least in the lower region. X-ray or fluoroscopic registration is therefore often employed.

Many conventional patient positioners use pads or poles that are fixed to an arm system of the operating table or to similar fixed means. Such a mechanical positioner is known, for example, from U.S. Pat. No. 6,311,349.

In addition to mechanical positioners, there are also positioners that comprise navigation reference means for medical navigation; such a positioner is known, for example, from WO 2004/089192 A2. The reference means are used to indirectly localize the ASIS and pubic points, which can be used to register the front pelvic plane.

When registering the ASIS points and pubic points by manually tapping the points and access to these points is impeded by the presence of a positioning means, it is necessary to fall back on fluoroscopic registration. There are positioning means for this purpose that are made of a material that is as radiolucent as possible and comprise the supporting devices already mentioned above, e.g., poles and pads, which are fixed to a carrier system (on a guiding rail) of the operating table. A problem with these existing positioning means for navigation software arises when both fluoroscopic images are to be recorded for registration and image-free registration is to be performed (e.g., by moving a navigation pointer to said points). Despite the at least largely radiolucent material used in the positioning means, it still can cause shadows and edges on the images. On the x-ray recording 60 in FIG. 7, for example, a region 61 is marked that shows the shadow of a patient positioner, which is hiding the left-hand os pubis structure. FIG. 8 shows a fluoroscopic recording 62 obtained using a "radiolucent" positioner, which also shows how the shadow 63 of a part of the positioner hides the content of the image and weakens the contrast.

Another problem with the known positioning devices for lateral positioning arises when adipose patient tissue overlaps the pelvic rim marks. This makes it difficult or impossible to tap these points with a navigation pointer. Moving a pointer to the pelvic landmarks in this way also is often obstructed by the poles and pads. For this reason, the patient is initially positioned supine, registration is performed and the patient is then repositioned laterally. This is not only time-consuming but also critical with regard to sterility, which may be lost as result of repositioning.

All the aforementioned disruptions to the registration procedure, e.g., a lack of or incorrect image-free tapping with a pointer or a misinterpretation of fluoroscopic images due to shadows or a lack of contrast, can lead to incorrect registration and therefore errors in navigation, which can in turn have a negative effect on the treatment result.

SUMMARY OF THE INVENTION

A patient lateral positioning device in accordance with the invention for pelvic treatments, by means of which the patient is supported in a defined lateral position, comprises a vacuum mattress that includes an upper body supporting part and a lower body supporting part, and substantially omits the pelvic region on the front side and on the upper side of the positioned patient. In other words, the positioning device in accordance with the invention provides a lateral positioning device comprising a vacuum mattress that allows access to and/or substantially leaves free the locations on the patient that are to be freely accessible for the treatment and for fluoroscopic registration or image-free registration.

Reference markers or arrays can be attached to the positioning device and detected by a medical tracking or navigation system so as to enable image guided surgery. For example, the medical tracking or navigation system may include infrared cameras or the like that can detect three-dimensional spatial positions of the reference markers attached to the positioning device as well as to markers attached to medical instruments. This position data can be used in conjunction with previously obtained image data, which can be stored in the navigation system, so as to provide guidance to the surgeon.

It should be noted here that using the lateral positioning device in accordance with the invention, it is already possible to perform optimum image-free registration, e.g., tapping landmark points on the pelvis with a navigation pointer, if the vacuum mattress in the pelvic region omits the front side and upper side of the patient. For said image-free registration, the vacuum mattress still can be easily provided on the rear side of the patient, in order to exercise an additional supporting function.

In one embodiment in accordance with the invention, the vacuum mattress also substantially omits the pelvic region on the rear side of the patient. In this embodiment, the radiation path for fluoroscopic registration is then completely free of any supporting means, and the images obtained contain high-contrast representations that enable landmarks to be unambiguously assigned in a computer-assisted way. It is thus possible to optimally perform both an image-free registration and an image-assisted registration.

The vacuum mattress can be embodied as a single piece and comprise a narrow connecting part between the upper body supporting part and the lower body supporting part, wherein when the patient is in the lateral position, the connecting part comes to rest substantially beneath the patient. In accordance with such an embodiment, the vacuum mattress can have a wide upper body supporting part, a narrower lower body supporting part and an even narrower connecting part between the upper and lower parts. In particular, the upper body supporting part is the widest part of the vacuum mattress so as to support the patient's upper body from beneath while in the lateral position and from both sides over a substantial part of the upper body. The lower body supporting part is narrower than the upper body supporting part so as to at least partly encompass at least one of the patient's legs, wherein the connecting part is the narrowest part and is narrower than the lower body supporting part.

In another embodiment in accordance with the invention, the vacuum mattress can be embodied in two parts and individually comprise an upper body supporting part and a lower body supporting part, respectively.

In accordance with another embodiment, the upper body support, the lower body support, and the connecting part are formed as an integral unit.

In accordance with another embodiment in accordance with the invention, the device also comprises a support base for the vacuum mattress or its parts, which can be tilted into predefined angular positions. The support base can be formed from a rigid material as a plate, and it is possible to provide a support base for the upper body supporting part and the lower body supporting part that is in particular formed in two parts, e.g., comprises one support base part for the upper body supporting part and one support base part of the lower body supporting part.

In accordance with another embodiment, the support base or its parts have two plate portions that are at a predefined angle to each other and can be tilted via a tilting edge in their connecting region. In this case, an angle of about 45 degrees can be selected. It is advantageous if a tilting aid is provided in the region of the tilting edge, in particular a tilting roller along the tilting edge. In order to make tilting easier for the user, a manipulating device for lifting or tilting the support base can be provided on the support base and can comprise grip portions on the plate rims and/or supporting portions beneath the plate portions.

The patient positioning device (lateral positioning device) in accordance with the invention is capable of fixing the patient in a lateral position on the treatment table, for example during a hip joint replacement operation and while recording fluoroscopic images, without creating shadows or edges in the fluoroscopic image. In addition to the fact that the radiation of the fluoroscopic image is not obstructed, it is also advantageously possible to reposition the patient from a lateral position into a position tilted by about 45 degrees (and vice versa), in order to be able to register the anatomical structures, such as for example pelvic landmarks (ASIS and pubic points) with a navigation pointer. The specially shaped vacuum mattress covers the entire body except for the main part of the pelvic region to be treated (pelvic joint region) and provides a stable fixation for the patient. Important anatomical structures, such as the os pubis, for example, are not covered by fixation material. This is advantageous because such structures of the pelvis are required in order to automatically detect the position of the patient's pelvis via software. The operating environment is also freely accessible for the surgeon. The fluoroscopic images will not exhibit any disrupting shadows and edges, which could lead to incorrect registrations when using the software.

FIG. 9 shows an exemplary fluoroscopic image 64 that has been produced using the lateral positioning device in accordance with the invention. The image does not exhibit any disrupting shadows and edges, and the contrast is strong enough to enable image-assisted registration.

A second advantage of the device in accordance with the invention as compared to known positioning devices is provided by the repositioning mechanism (tilting mechanism). Using this integrated mechanism, it is possible to move a patient from the lateral position into a position tilted by about 45 degrees. This feature enables the surgeon to move the patient in a simple and defined way into a 45 degree tilted lateral position, before or after the sterile environment is created. When the patient is positioned in this way, it is easier to register the anatomical landmarks because any adipose tissue that may be present does not overlap the regions that the pointing apparatus (navigation pointer) is positioned. After registration, the patient can be quickly and easily repositioned, without any loss of sterility.

The device in accordance with the invention is flexible and can be adapted to any human build and any operating table environment. It is suitable for slim and adipose patients, and the soft material of the vacuum mattress avoids injuries or bedsores on the patient's body.

The positioning device in accordance with the invention is explained below in more detail on the basis of an example embodiment and by referring to the enclosed drawings.

BRIEF DESCRIPTION OF THE DRAWINGS

The forgoing and other features of the invention are hereinafter discussed with reference to the drawings.

DETAILED DESCRIPTION

Figure 1:
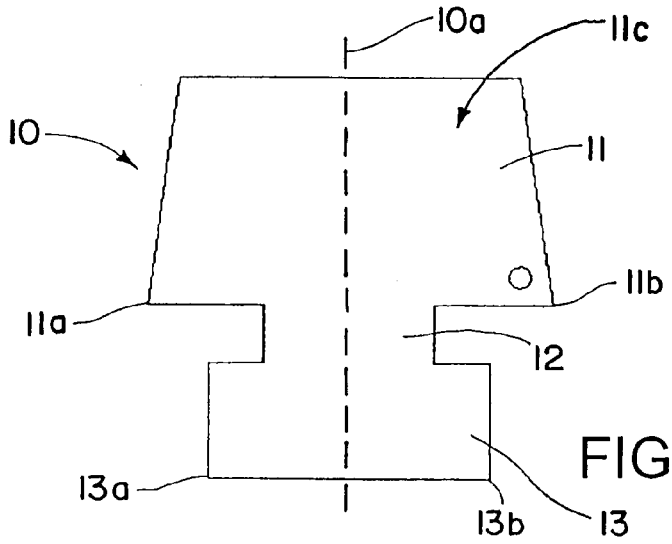
FIG. 1 is an outline of an exemplary vacuum mattress for a lateral positioning device in accordance with the invention.
Figure 2:
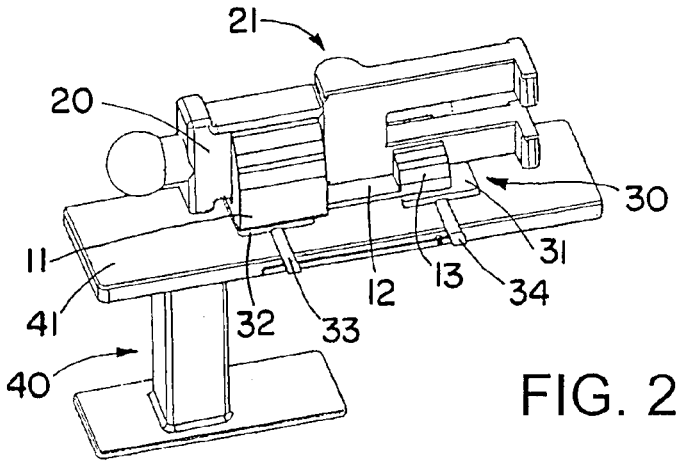
FIGS. 2 and 3 illustrate a patient positioned on an operating table with the aid of the lateral positioning device in accordance with the invention from the front and rear sides.
Figure 3:
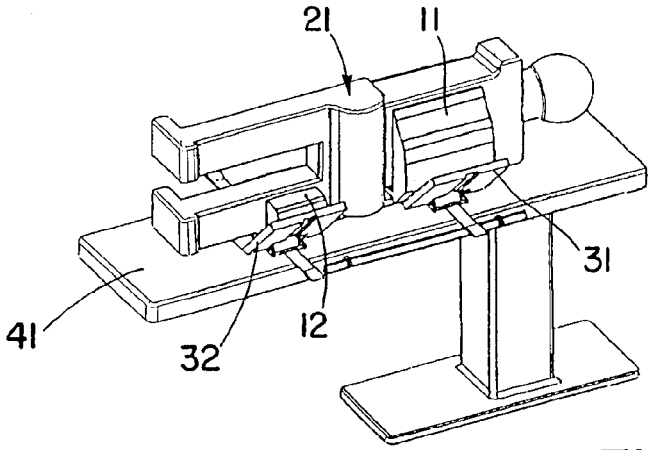

FIG. 1 shows a view from above (outline) onto an exemplary vacuum mattress 10 for a patient lateral positioning device in accordance with the invention. The exemplary mattress 10 has the basic shape of a Roman numeral I and includes an upper body supporting part 11, a lower body supporting part 13 and a connecting part 12 between said two parts 11 and 13. The patient is laterally positioned onto the central longitudinal axis 10*a* of the vacuum mattress 10, such that the two wings 11*a* and 11*b* of the upper body supporting part 11 can be bent upwards around the upper body, and the two wings 13*a* and 13*b* of the lower body supporting part 13 can partly encompass the lower leg from beneath. The air is then removed from the vacuum mattress, and a filler material 11*c*, such as polystyrene balls, contained in the mattress adapt to the shape of the patient's body and fix the body. The patient is then lying laterally on the operating table as shown in FIGS. 2 and 3. FIG. 2 shows the patient from the front side, FIG. 3 shows the patient from the rear side. The patient 20 is fixed in the mattress 10, such that the two parts 11 and 13 protrude upwards in the region of the upper body and at the leg, respectively, and fix the body and the leg. The connecting part 12 lies flat beneath the patient's pelvis.

Figure 4:
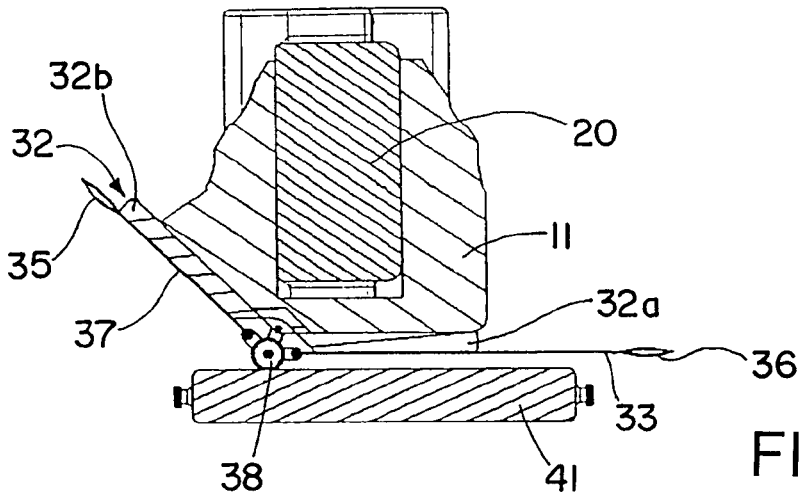
FIGS. 4 and 5 illustrate an exemplary repositioning and/or tilting mechanism for laterally positioning a patient in accordance with the invention.

The patient is laterally positioned on an operating table 40, namely on its upper plate 41. In the embodiment shown, a tilting mechanism 30 is also provided between the vacuum mattress 10 and the table plate 41, and includes a support base including two separate angled plates 31 and 32, as well as grips 34, 35, 36 and straps 33, 37 (FIGS. 2-4). The function of the tilting mechanism is explained below in more detail on the basis of FIGS. 4 and 5. It also follows from FIGS. 2 and 3 that when the patient is laterally positioned via the positioning device in accordance with the invention, the operating area 21 is completely accessible to the surgeon. Further, no parts of the patient fixation device are provided on the front side or rear side of the pelvis, which would obstruct fluoroscopic recordings or the tapping of registration points (pelvic landmarks) using navigation pointers.

Figure 5:
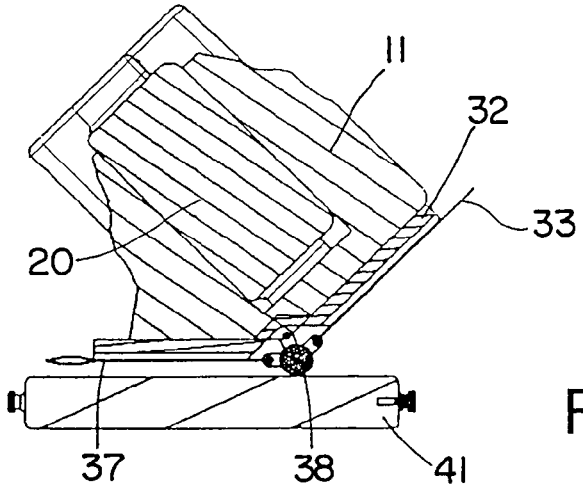

Referring now to FIG. 4, the patient 20 is lying in the linear lateral position in which the operation can be performed. The position in FIG. 5 is the position tilted by 45 degrees, which is also shown as a whole in FIG. 6, wherein the front side of the patient points obliquely upwards. The plane of intersection runs centrally through the grip 33 on the upper body (see FIG. 2).

The tilting mechanism lies on top of the table plate 41 and comprises an angled plate 32 made of a rigid material and comprising two plate portions 32*a*, 32*b*, which are connected to each other such that they form an angle of 135 degrees (interior angle) with respect to each other. Straps 37 run beneath the plate portions 32*a*, 32*b* and end in grips 34, 35, 36 at the rims of the plate portions. A tilting roller 38 runs along the tilting edge and comprises attaching appendages (not indicated) for the straps 33 and 37. The lower end of the upper body supporting part 11 lies flat and conformed on the plate 32.

Figure 6:
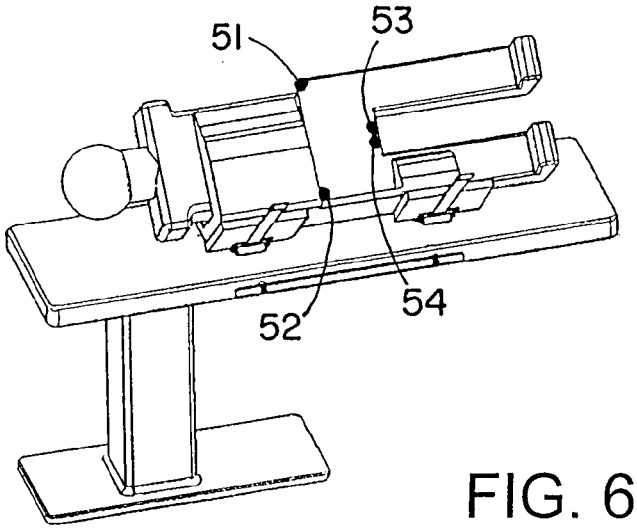
FIG. 6 illustrates a positioned patient in the tilted position.
Figure 7:
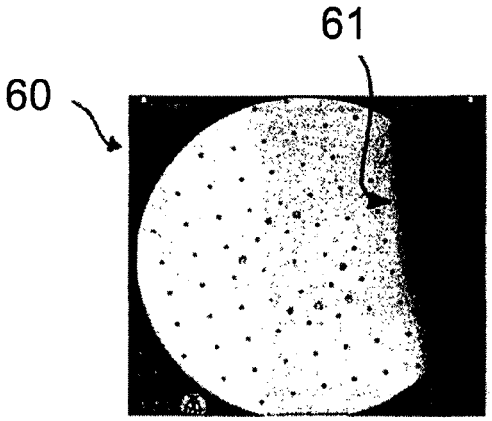
FIG. 7 PRIOR ART
FIGS. 7 and 8 illustrate unsuitable fluoroscopic images of the pelvic region, as created using lateral positioning in accordance with the prior art.
Figure 8:
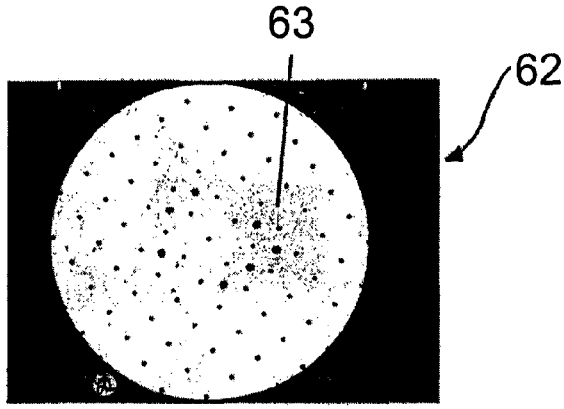
FIG. 8 PRIOR ART

If one then wishes to move the patient 20 from the position shown in FIG. 2 into the position shown in FIG. 6, such that he is lying inclined by 45 degrees and his front side points obliquely upwards, the support base 30, i.e., the plates 31 and 32, respectively, can very easily be tilted with the aid of the grips 34, 35, 36, wherein an angle between plates 31 and 32 can be altered via the tilting roller 38 and can easily be moved into the position shown in FIG. 5 and FIG. 6, respectively. The support base part 31 (FIG. 2) is simultaneously tilted accordingly, wherein the patient is still fixedly positioned, because the conformed vacuum mattress rests on the plate portion 32*b*.

When the patient has then been moved by the tilting procedure just described into the position shown in FIGS. 5 and 6, the pelvic landmark points (ASIS and pubic points 51, 52, 53 and 54) are easily accessible and can easily be tapped using a navigated pointer. Image-free registration thus can be performed unobstructed and reliably. After registration, the patient 20 can easily be returned again to his original position (90 degree lateral position) with the aid of the tilting mechanism, without creating any sterility problems. Because the support base (the two plates 31, 32 of the tilting mechanism) are attached next to the hip region, they also do not obstruct the fluoroscopic image recordings.

One possible workflow using the patient lateral positioning device in accordance with the invention is as follows:

1. positioning the patient in the lateral position in the vacuum mattress;
2. repositioning the patient into the position tilted by 45 degrees;
3. creating the sterile environment;
4. attaching reference arrays to the patient;
5. registering the anatomical landmarks using a navigation pointer;
6. repositioning the patient back into the lateral position;
7. beginning the operation.

Figure 9:
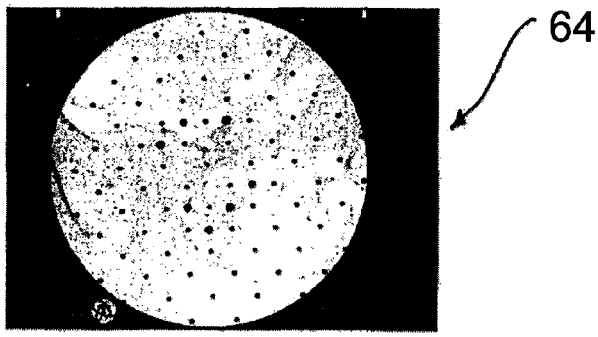
FIG. 9 illustrate an optimum fluoroscopic image recording of the pelvic region, as created using a lateral positioning device in accordance with the present invention.

FIG. 9 shows an exemplary fluoroscopic image 64 that has been produced using the lateral positioning device in accordance with the invention. The image does not exhibit any disrupting shadows and edges, and the contrast is strong enough to enable image-assisted registration.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A patient lateral positioning device suitable to support a patient in a defined lateral position during pelvic treatments, comprising a vacuum mattress including an upper body support attachable to an upper body portion of the patient, a lower body support attachable to a lower body portion of the patient, and a connecting part extending longitudinally between the upper body support and the lower body support that connects the upper body support to the lower body support, wherein when the patient is in the lateral position, said connecting part comes to rest beneath the patient, and wherein a region between said upper and lower body support is formed such that when the vacuum mattress is attached to the patient, both a front pelvic side and an upper pelvic side of the patient are exposed.

2. The device according to claim 1, wherein the region between said upper and lower body support is formed such that when the vacuum mattress is attached to the patient, a rear pelvic side is exposed.

3. The device according to claim 1, wherein the upper body support, the lower body support, and the connecting part are formed as an integral unit.

4. The device according to claim 1, wherein the upper body support is the widest portion of the vacuum mattress, the lower body support is narrower than the upper body support, and the connecting part is narrower than the lower body support.

5. The device according to claim 1, wherein the upper body support is formed separate from the lower body support.

6. The device according to claim 1, further comprising a support base for supporting the vacuum mattress, said support base operable to lift or tilt into predefined angular positions.

7. The device according to claim 6, wherein the support base is formed from a rigid material in the form of a plate.

8. The device according to claim 6, wherein the support base supports both the upper body support and lower body support of the vacuum mattress.

9. The device according to claim 6, wherein the support base comprises two plate portions connected to one another, wherein a first plate portion can be tilted relative to a second plate portion.

10. The device according to claim 9, further comprising a tilting roller coupling the first plate portion to the second plate portion.

11. The device according to claim 9, wherein the support base includes an adjustment device operative to lift or tilt the support base.

12. The device according to claim 11, wherein the adjustment device comprises supporting portions beneath the plate portions.

13. The device according to claim 6, wherein the support base includes an adjustment device operative to lift or tilt the support base.

14. The device according to claim 13, wherein the adjustment device comprises grip portions on rims of a plate.

15. The device according to claim 1, further comprising polystyrene balls arranged inside the vacuum mattress.

16. A patient lateral positioning device suitable to support a patient in a defined lateral position during pelvic treatments, comprising:

a vacuum mattress including:

an upper body support attachable to an upper body portion of the patient, and a lower body support attachable to a lower body portion of the patient; and a support base for supporting the vacuum mattress, said support base being pivotable between first and second positions for moving the upper and lower body supports to different predefined angular positions;

wherein a region between said upper and lower body support is formed such that when the vacuum mattress is attached to the patient, both a front pelvic side and an upper pelvic side of the patient are exposed.

* * * * *